US006056129A

United States Patent [19]

Ahearn et al.

[11] Patent Number: 6,056,129

[45] **Date of Patent: *May 2, 2000**

[54] DENTAL DELIVERY PLATFORM

[76] Inventors: David J. Ahearn, 10 High Meadow Rd., Little Compton, R.I. 02837; Peter Van Colen, 3842 Main Rd., Tiverton, R.I. 02878

[ * ] Notice: This patent issued on a continued prosecution application filed under 37 CFR 1.53(d), and is subject to the twenty year patent term provisions of 35 U.S.C. 154(a)(2).

[21] Appl. No.: 08/858,870

[22] Filed: May 19, 1997

Related U.S. Application Data

[63] Continuation of application No. 08/422,339, Apr. 14, 1995.

[51] Int. Cl.[7] ..... A47F 7/00

[52] U.S. Cl. ..... 211/70.6; 312/209; 312/140.4; 108/92; 108/150; 108/26

[58] Field of Search ..... 312/209, 206, 312/196, 140.4; 108/25, 69, 101, 92, 26, 150; 211/70.6, 119.005, FOR 100, 71.01

[56] References Cited

U.S. PATENT DOCUMENTS

| | | | |
|---|---|---|---|
| 200,829 | 3/1878 | Hanks . | |
| D. 232,940 | 9/1974 | Atkinson | D24/1 B |
| D. 302,585 | 8/1989 | Elliott | D24/4.5 |
| 362,916 | 5/1887 | Zeigler | 108/26 X |
| 893,155 | 7/1908 | Evans | 312/209 |
| 1,113,991 | 10/1914 | Henderson | 108/150 |
| 1,523,875 | 1/1925 | Iseman et al. | 108/101 |
| 1,644,830 | 10/1927 | Henderson | 312/209 |
| 1,853,526 | 4/1932 | Wetmore et al. | 108/92 X |
| 1,992,564 | 2/1935 | Amdur | 312/206 X |
| 2,129,396 | 9/1938 | Archer | 108/92 X |
| 2,450,337 | 9/1948 | Hearst | 312/209 X |
| 2,575,661 | 11/1951 | Hickey | 312/209 X |
| 2,678,489 | 5/1954 | Ratzlaff et al. | 312/196 X |
| 2,846,808 | 8/1958 | Ivester | 108/92 X |
| 2,868,760 | 1/1959 | Staicopoulos | 260/41 |
| 3,210,846 | 10/1965 | Balkin | 32/22 |
| 3,229,368 | 1/1966 | Tocchini | 32/22 |
| 3,386,444 | 6/1968 | Brenner | 108/25 |
| 3,460,899 | 8/1969 | Miller | 312/209 X |
| 3,597,033 | 8/1971 | Slouka | 312/209 |
| 3,789,051 | 1/1974 | Rees et al. | 260/41 |
| 3,966,286 | 6/1976 | Groseclose | 312/209 X |
| 4,013,328 | 3/1977 | Wolf et al. | 312/209 |
| 4,094,255 | 6/1978 | Zaccaria | 108/150 X |
| 4,373,639 | 2/1983 | Tricon | 211/119.005 |
| 4,437,411 | 3/1984 | Maxwell | 312/209 X |
| 4,501,201 | 2/1985 | Fitzner et al. | 108/150 X |
| 4,730,880 | 3/1988 | Schmidt | 312/209 |
| 4,914,873 | 4/1990 | Newhouse | 52/239 X |
| 4,934,933 | 6/1990 | Fuchs | 433/79 |
| 5,103,741 | 4/1992 | Grund et al. | 108/101 X |
| 5,302,014 | 4/1994 | Hobson | 211/70.6 X |
| 5,615,782 | 4/1997 | Choe | 211/70.6 |
| 5,746,488 | 5/1998 | LaCour | 312/196 |
| 5,860,534 | 1/1999 | Minneman et al. | 108/150 X |

FOREIGN PATENT DOCUMENTS

| | | | |
|---|---|---|---|
| 1374347 | 8/1964 | France | 312/209 |
| 1466127 | 12/1966 | France | 312/209 |
| 2537439 | 6/1984 | France | 312/209 |
| 2511735 | 9/1976 | Germany | 108/26 |
| 2804199 | 8/1979 | Germany | 312/209 |
| 4015460 | 11/1991 | Germany | 211/70.6 |
| 36294 | 11/1922 | Norway | 211/100 |

OTHER PUBLICATIONS

Millcare, a Herman Miller company, Millcare Carts Catalogue, sixteenth copied page received Sep. 21, 1994.

Resnick et al., "Stability and Inactivation of HTLV–III/LAV Under Clinical and Laboratory Environments," JAMA 255:1887 (1986).

*Primary Examiner*—Peter R. Brown
*Assistant Examiner*—David E. Allred
*Attorney, Agent, or Firm*—Medlen & Carroll, LLP

[57] ABSTRACT

A three dimensional dental delivery platform is described with instrument holders milled directly into the solid surface of the platform. The design, while affording a simple construction, avoids the creation of corners and crevices, thus allowing for simpler and more rapid disinfection.

12 Claims, 11 Drawing Sheets

DENTAL DELIVERY PLATFORM

This Appln is a con of Ser. No. 08/422,339 Apr. 14, 1995.

FIELD OF THE INVENTION

The present invention relates generally to the field of dental equipment, and more particularly to dental carts and the like which provide a mobile work surface for both the dentist and dental assistant.

BACKGROUND OF THE INVENTION

The ideal dental treatment room is constructed and equipped to provide essential dental services as effectively and efficiently as possible. With this goal in mind, various prior art dental carts have been designed to provide a mobile work surface, with cabinetry for access to dental instruments and supplies. See, for example Slouka, U.S. Pat. No. 3,597,033; Tocchini, U.S. Pat. No. 3,229,368; and Elliot, U.S. Design Pat. No. 302,585. In addition, there exist more expansive dental work stations and treatment room cabinet structures that also attempt to achieve minimum doctor time and motion and maximum efficiency. See Wolf el al., U.S. Pat. No. 4,013,328; and Fuchs, U.S. Pat. No. 4,934,933.

Unfortunately, the prior art emphasis on efficiency can often conflict with the need to ensure safe hygiene in the dental treatment room. Prior art dental carts achieve their objective in part by allowing for positioning of the dental workspace in close proximity to the patient. However, the immediacy of the dental workspace and associated instruments to the patient necessarily increases the risk of contamination during a procedure, thereby endangering both the dental worker and subsequent patients. This problem is compounded in the prior art designs, since the cabinetry and bracket structures utilized in these devices are difficult to safely and rapidly disinfect after each patient visit.

Concern over dental hygiene has become particularly acute following recognition of the Acquired Immune Deficiency Syndrome (AIDS). Infectious human immunodeficiency virus, or HIV, can persist in a liquid or dried state for prolonged periods of time, possibly even at elevated temperatures. Resnick et al., JAMA 255:1887 (1986). Accordingly, a thorough and effective disinfection of the dental workspace following an invasive procedure is an essential precaution to prevent the transmission of this potentially deadly virus. The corners and crevices created by prior art designs complicate this procedure. In view of the ever-present need for hygiene and the rapidly growing concern over the transmission of certain viral and bacterial agents, what is needed is a dental delivery platform that can be quickly and completely disinfected.

The rapid increase in technology and instrumentation in the dental treatment room in recent years has also rendered many of the prior art designs obsolete in view of the efficiency goal as well. In order to be effective a dental delivery platform must provide easy access to a growing variety of instruments, resins, implants and various consumables, as well as X-ray and computer equipment. Moreover, equally important to ease of access is ease of disposal for sharp objects and medical waste generated during a dental procedure. The prior art designs considered herein fail to fully satisfy both of these requirements. What is needed is a dental delivery platform with effective means for viewing and accessing the various dental instruments and consumables, and equipped with safe and accessible disposal bins for needles, blades, medical waste and the like.

SUMMARY OF THE INVENTION

Accordingly, it is an object of the present invention to remedy the disadvantages encountered in prior art constructions, through the provision of a three-dimensional dental delivery platform with instrument holders milled directly into the solid surface of the platform itself. This design, while affording a simple construction, avoids the creation of corners and crevices on the proximal edge of the work surface by hanging brackets and the like, thus allowing for simpler and more rapid disinfection.

The present invention also incorporates a series of angled containers on the distal edge of the workspace, to ensure both visual and physical access to dental materials stored therein. It is contemplated that the containers can be individually configured by the user as dispensing units of varying sizes, and also as disposal bins for the safe receipt of sharps and other medical waste. It is further contemplated that the containers can be individually removed from the platform for refilling and restocking, and further are stackable for ease of transport to a supply area of the dental office. The present invention further incorporates a second-tier platform structure, to provide a repository for instruments and other materials during a dental procedure, so that both a lower primary work surface and an upper secondary work surface are created. The present invention is designed to optimize the functionality of the dental work space by condensing it into a more economical, functional and hygenic form.

It is contemplated that the work surfaces of the dental delivery platform be preferably composed of a single solid sheet of Corian™ or similar methacrylate resin material. Methacrylate resins are described in Staicopoulos, U.S. Pat. No. 2,868,760, hereby incorporated by reference and Rees et al., U.S. Pat. No. 3,789,051, hereby incorporated by reference. Corian™ slab stock is a solid homogenous acrylic polymer made from methacrylate resin, which is a synthetic resinous plastic that incorporates a filler material, such as calcium carbonate. It is further contemplated that the chosen methacrylate resin material can be milled or molded in accordance with the method of the present invention to produce inset instrument holders. The advantage in utilizing a solid sheet of this material, as opposed to its use as merely a laminate surface layer, is the ability to create a single continuous surface, including instrument holders, which can be quickly and completely disinfected. However, it is not intended that the invention be limited by the material used in its construction. Alternative materials which can provide a flat, even surface, such as fiberglass or other types of hardened plastic, are equally appropriate for use in the present invention.

Accordingly, it is contemplated that the dental delivery platform of the present invention will have a primary work surface with a plurality of instrument holders milled directly into a proximal edge of said primary work surface, and a plurality of containers attached to a distal edge of said primary work surface. It is further contemplated that the primary work surface may be composed of a single sheet of methacrylate resin material, fiberglass material or hardened plastic. It is also contemplated that the containers may be attached at an angle between 30 and 60 degrees relative to said primary work surface, and that the containers can be selectively configured by the user as dispensing units of adjustable sizes, by means of vertical partitions placed into a series of parallel grooves in each individual dispensing unit. The containers may also include disposal bins.

It is contemplated that the second-tier structure mounted on said primary work surface by means of supports may be comprised of an angled platform with a raised lower edge, and that the angle between said second-tier structure and said primary work surface ranges from 20 to 40 degrees. In an alternative embodiment, the second-story structure may be comprised of a plurality of angled containers. It is intended that the angle between said second-tier structure and said primary work surface satisfies the visual and reach motion requirements of the 95th-percentile man and woman.

It is not intended, however, that the location or number of the milled or molded instrument holders and/or the shape of the work surface itself be limited to one particular configuration. It is contemplated that the various elements of the dental delivery platform are readily adaptable to a number of combinations and the work surface can be configured accordingly. It is also not intended that the particular invention be limited by the type of base unit to which the proposed dental platform can be attached. The dental delivery platform contemplated by the present invention may be configured either as a moveable cart, a mechanical arm extendible over the patient, or a side or rear delivery system relative to the patient's chair, depending upon the individual practitioner's needs.

GENERAL DESCRIPTION OF THE INVENTION

Figure 1:
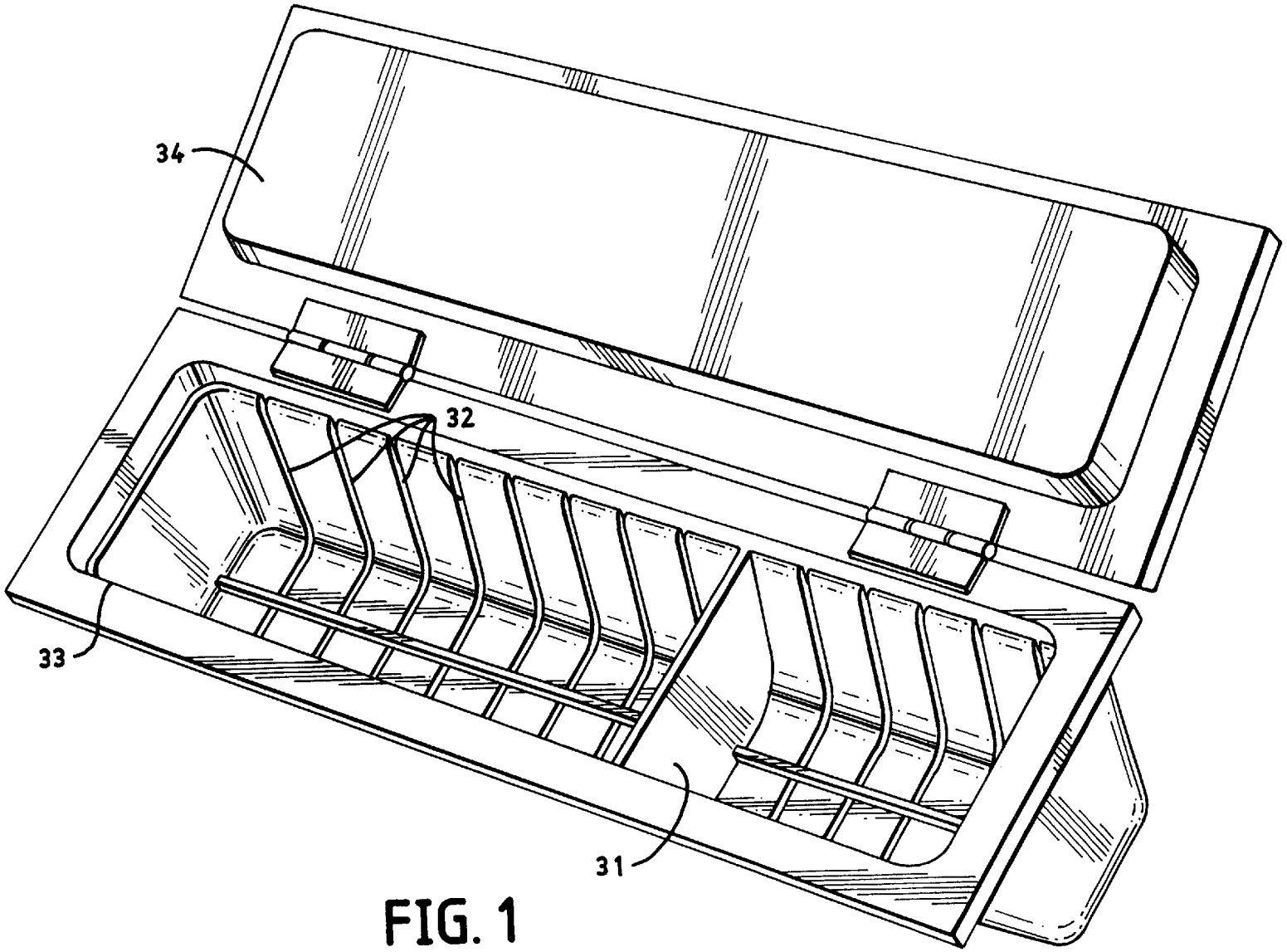
FIG. 1 is an overhead view of one embodiment of the slotted, reconfigurable, transportable and stackable dispensing unit contemplated by the present invention, having a hinged lid for ease of accessibility.

The present invention relates generally to the field of dental equipment, and more particularly to dental carts and the like which provide a mobile or adjustable work surface for both the dentist and dental assistant. A modern dental delivery platform must provide efficient and rapid access to all essential instruments and supplies, without compromising the ability of the practitioner to quickly and completely disinfect the immediate work surface between each patient visit. In addition, to ensure the safety of both the patient and the practitioner, a complete dental delivery platform must provide a safe and efficient means for disposing of the needles and blades often used in dental procedures, as well as the associated medical waste generated thereby. The present invention provides a dental delivery platform that satisfies both the hygienic and efficiency requisites, with a consumable delivery system that can be adapted to an individual user's particular requirements.

To this end, the present invention contemplates a dental delivery platform, comprising: a) a solid methacrylate work surface with instrument holders milled or molded directly into the edge of said surface, with b) angled containers arrayed along the distal edge of said work surface, and c) a second-tier structure, comprising a three-dimensional work station. It is contemplated that the containers would be capable of any number of user-defined configurations, including their use as dispensing units as well as containers for the disposal of sharps and medical waste. See FIGS. 1, 3, 8 and 9. It is further contemplated that the said second-tier platform may consist of an angled platform for the retention of dental instruments and the like, or alternatively may consist of an additional upper level of dispensing units. See FIGS. 8 and 9. The supports for said second-tier structure are located and fastened directly on to the Corian™ or similar methacrylate work surface. To maximize efficiency, the design and location of the instrument holders, brackets, containers and the second-tier platform structure were developed to accommodate the visual and reach/motion requirements of the 95th-percentile man and woman. The design of the present invention therefore results in the reduction of wasteful and repetitive motion, and thus yields a significant increase in productive capacity.

The present invention also includes a method of milling a solid sheet of Corian™ or a similar methacrylate material to produce inset instrument holders in a dental delivery platform, comprising the steps of first obtaining a Corian™ tray of appropriate dimensions, then drilling holes in the Corian™ surface where the instrument holders are to be located. A combination ream and chamfer drill is then used to ream these holes to a proper angle and tolerance, and the perimeter of the tray is then routed to soften both the edges of the tray and the edges that lead into the instrument holder holes. When the face side of the tray is complete it is flipped over and the holes for the brackets and stands are drilled and tapped. A special counterbore tool is then is used to counterbore the final instrument holder hole. Finally, when the milling procedures are done the Corian™ surfaces are sanded and buffed, resulting in a platform to be incorporated into the present invention.

DESCRIPTION OF THE PREFERRED EMBODIMENTS

Figure 7:
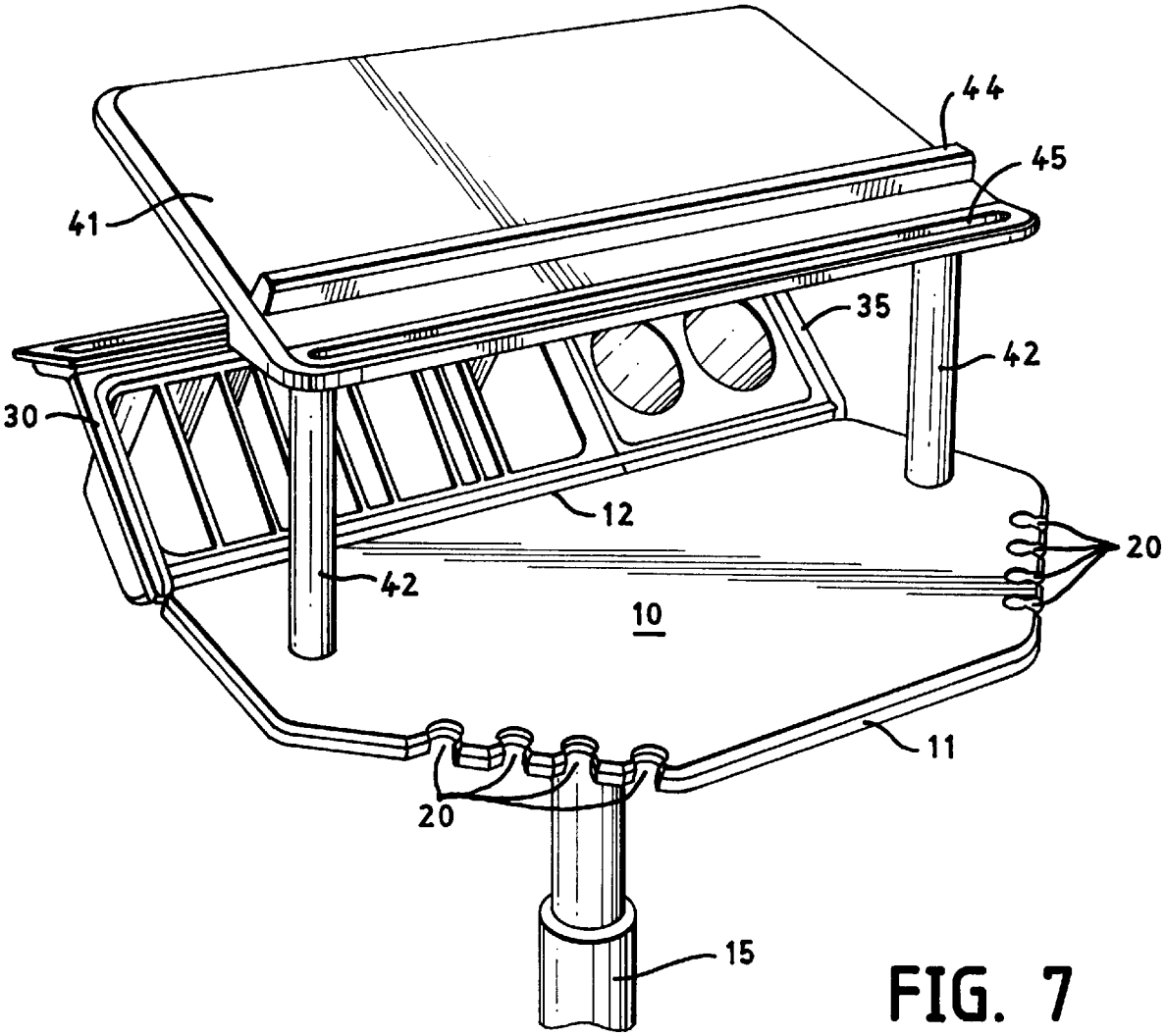
FIG. 7 is an overhead view of one embodiment of the dental delivery platform contemplated by the present invention, including one potential configuration of the rear bin bracket of FIG. 4 with dispensing units and a disposal bin container, and with a second-tier platform structure.

The structure of an exemplary embodiment of a dental delivery platform according to the present invention is shown in FIG. 7. Alternatively, the primary work surface (10) can also be incorporated onto a mobile dental cart or configured as a side or rear delivery cabinet, depending on the particular needs of the individual practitioner, in any manner also well known in the art. In one embodiment the primary work surface (10) is freely rotatable about a vertical axis of the base support (15). In an alternative embodiment the primary work surface (10) is fixed to the base support (15).

Figure 6:
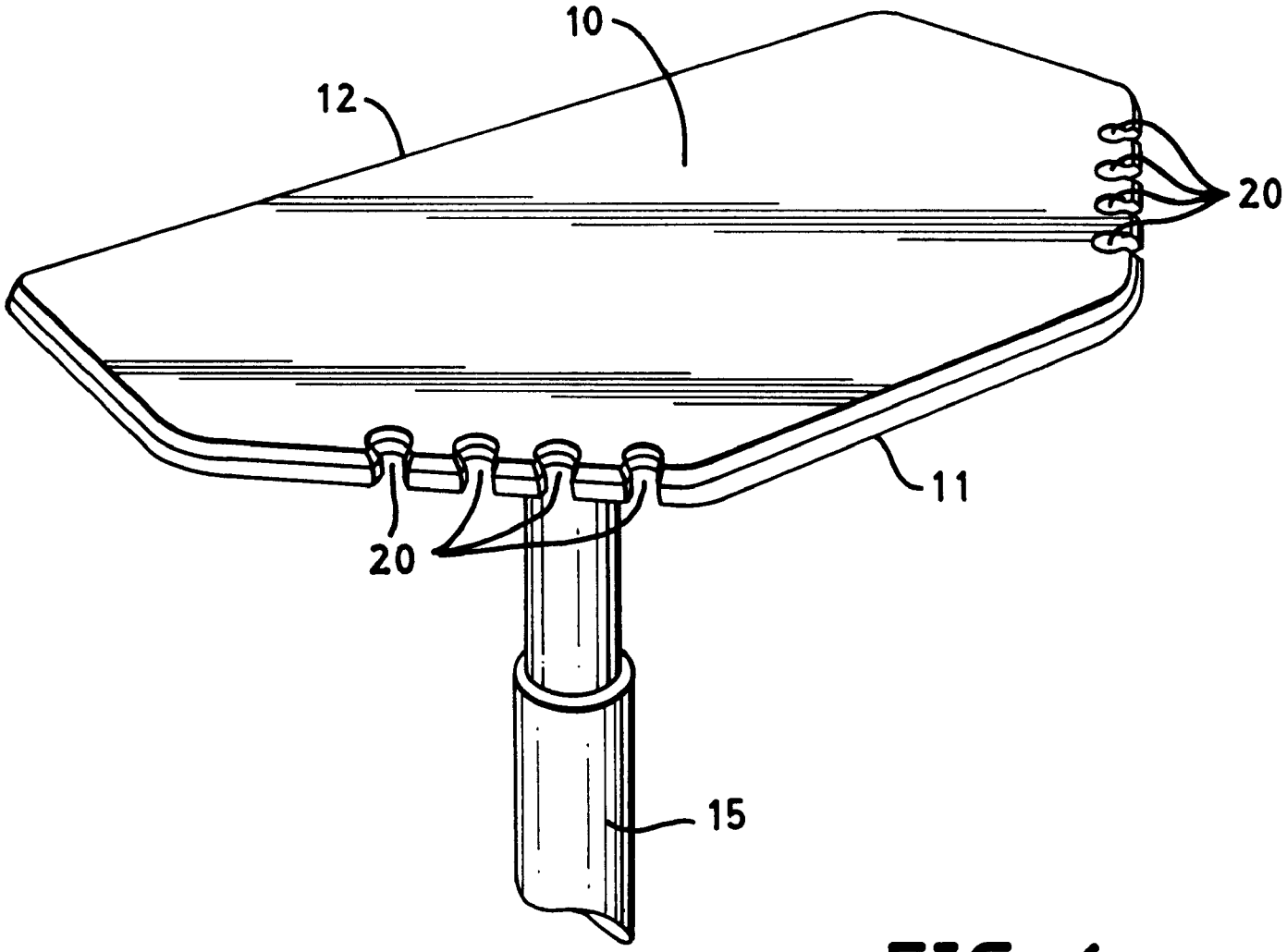
FIG. 6 is an overhead view of one embodiment of the continuous Corian™ or methacrylate work surface with milled instrument holders.
Figure 8:
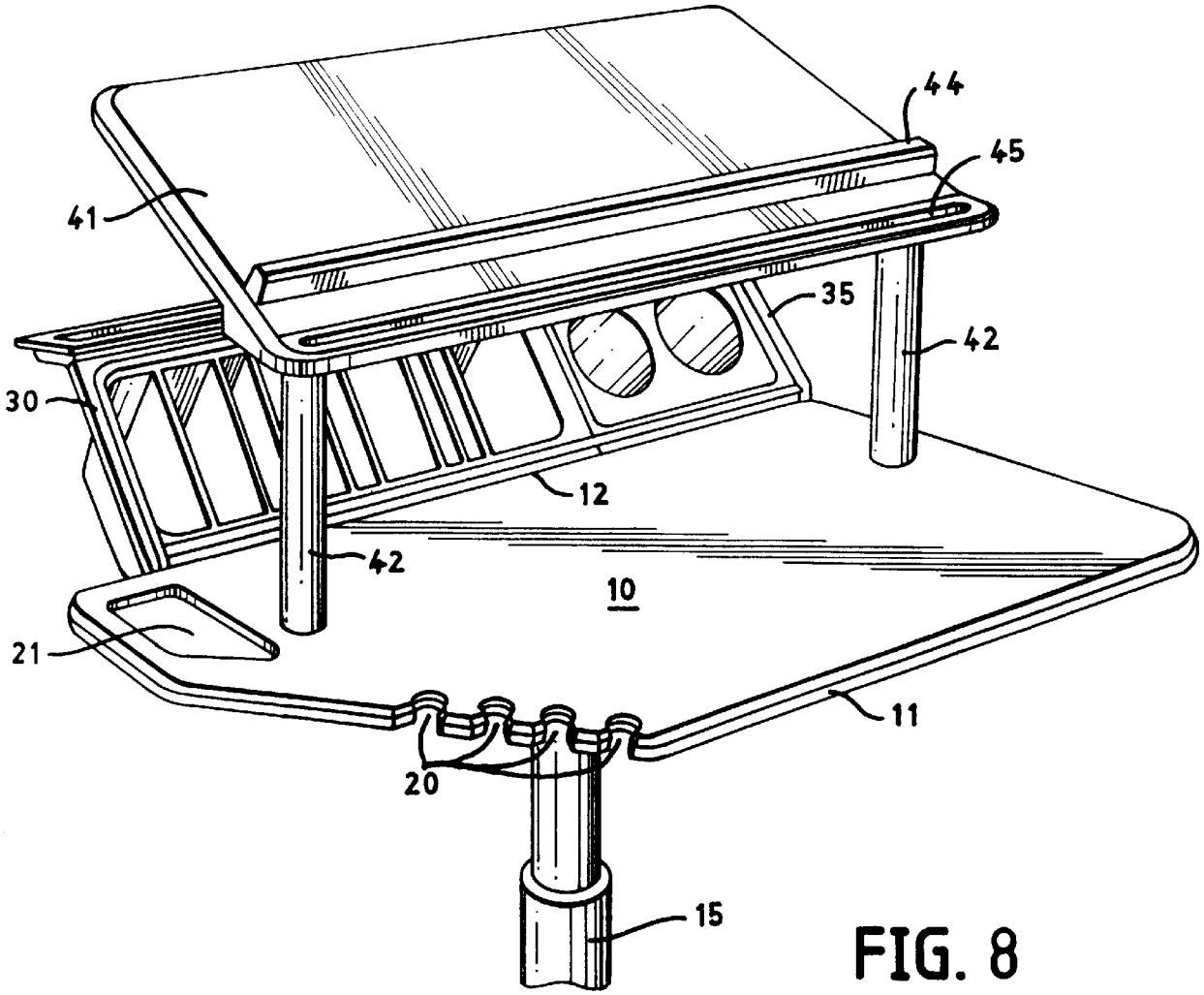
FIG. 8 is an overhead view of an alternative embodiment of the dental delivery platform shown in FIG. 7, with a recess in the work surface and additional inset instrument holders.
Figure 9:
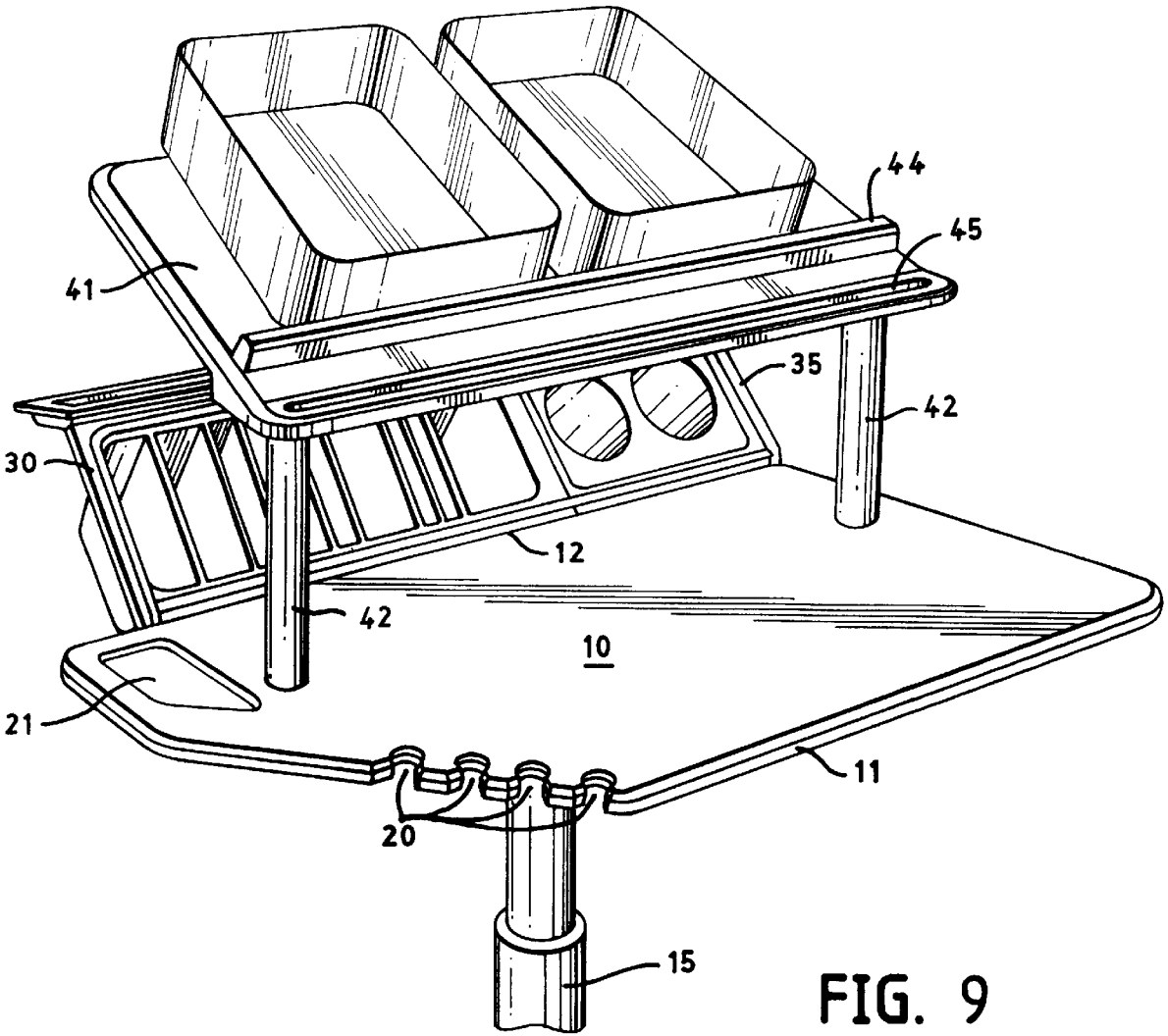
FIG. 9 is an overhead view of an alternative embodiment of the dental delivery platform shown in FIG. 8, with additional dispensing units deployed on the second-tier platform structure.
Figure 10:
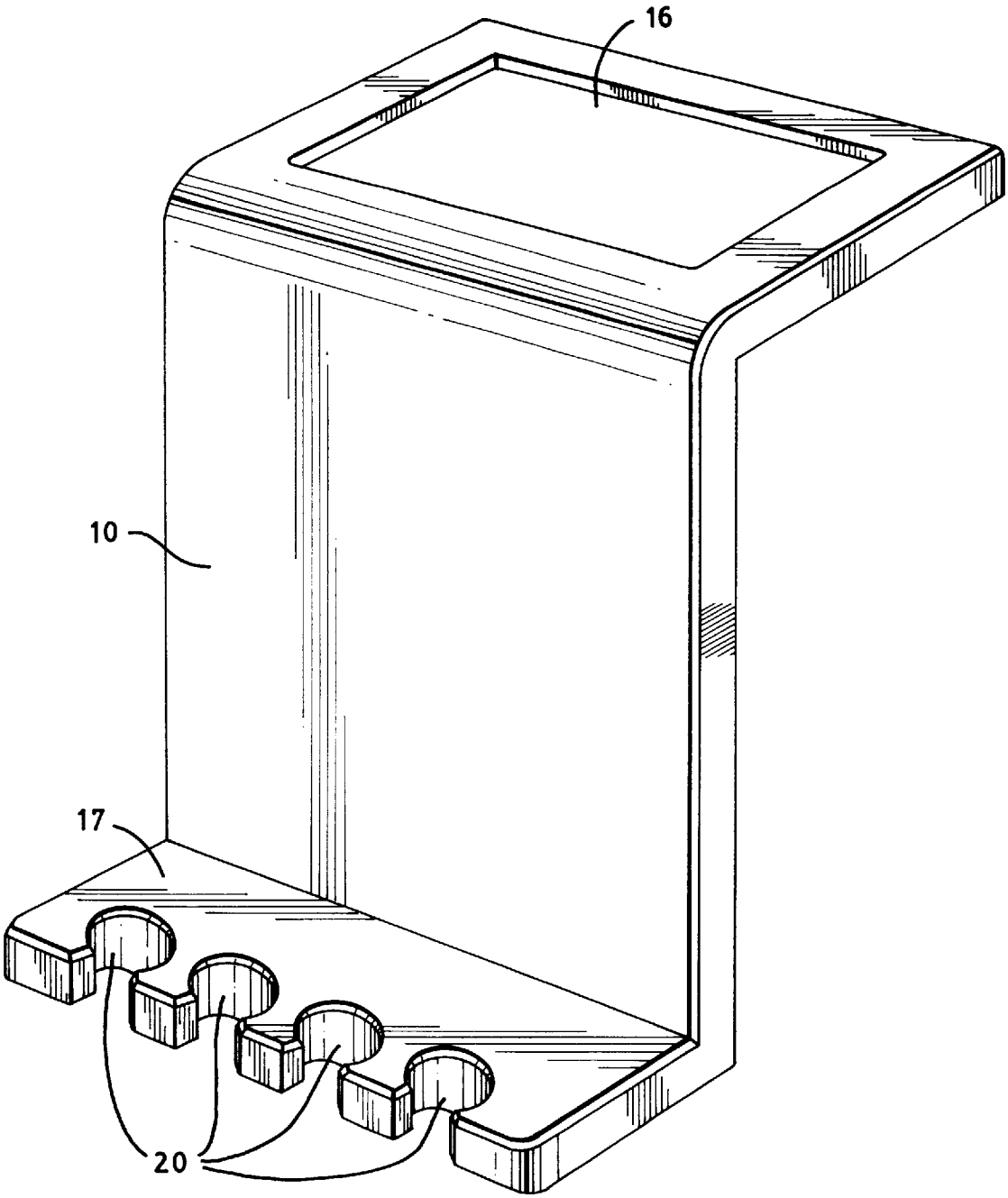
FIG. 10 is an overhead view of an alternative embodiment of the dental delivery platform of the present invention, with the platform configured as a minimal clearance side delivery system.
Figure 11:
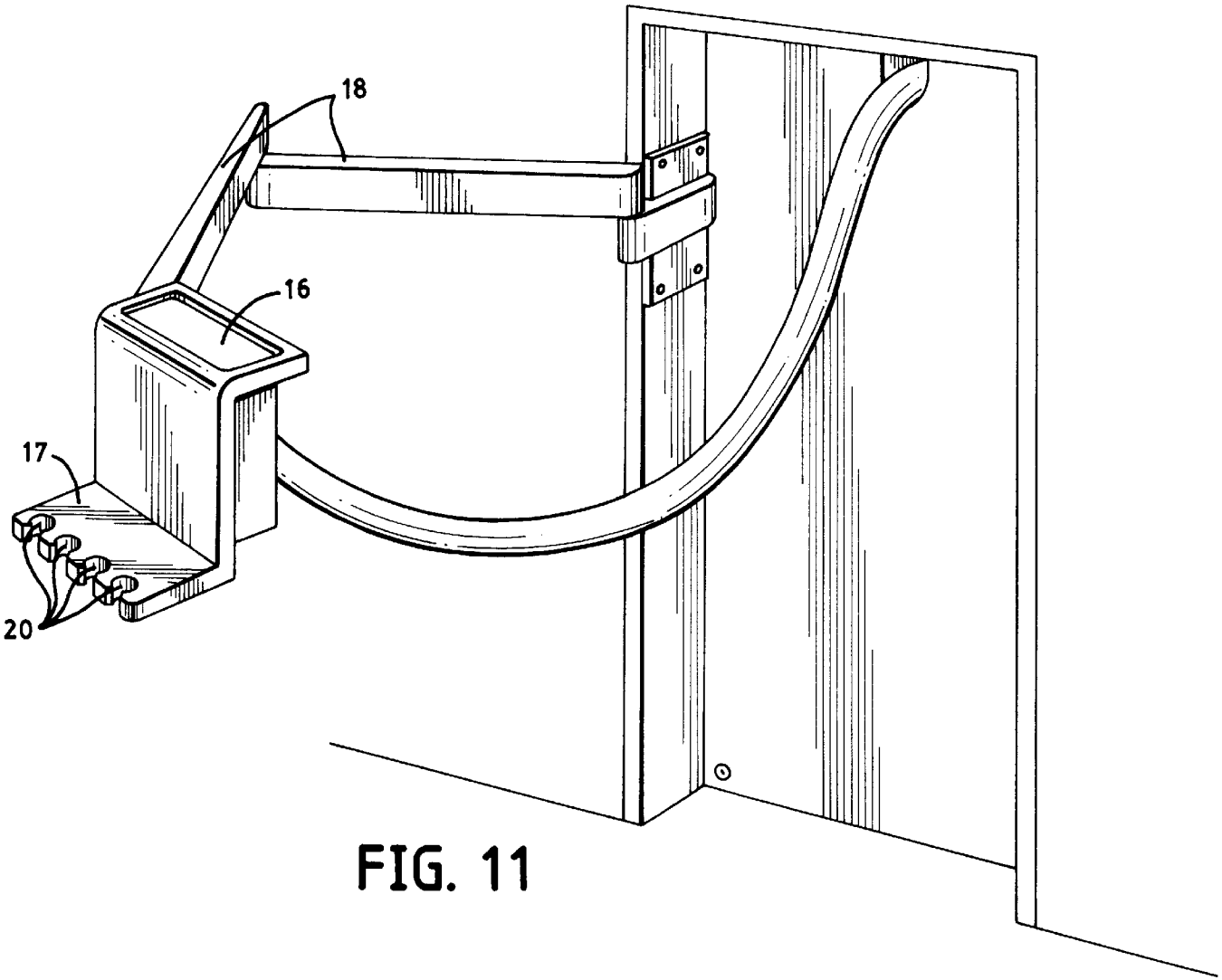
FIG. 11 is a side view of the molded bracket and tray of the side delivery system, mounted on a swing-out arm from a wall recess.

It is intended that the dental delivery platform of the present invention will consist of both a proximal (11) and a distal edge (12) relative to the user. In the preferred embodiment, the primary work surface (10) is configured with inset instrument holders (20) on both the left and right sides of the proximal edge (11) of the platform, as displayed in FIGS. 6 and 7. This embodiment allows for both left- and right-hand usage of the dental delivery platform, depending on individual preference. In an alternative embodiment, as shown in FIG. 8, the platform has inset instrument holders (20) on the left side of the proximal edge (11), and further incorporates a recess (21) milled into the left distal edge (12) for the retention of dental materials. In still another alternative embodiment, the primary work surface (10) can be configured as a molded bracket holder (16) and tray (17) on a swing arm apparatus (18), designed so as to provide a minimal clearance asepsis side delivery system. See FIGS. 10 and 11.

Figure 2:
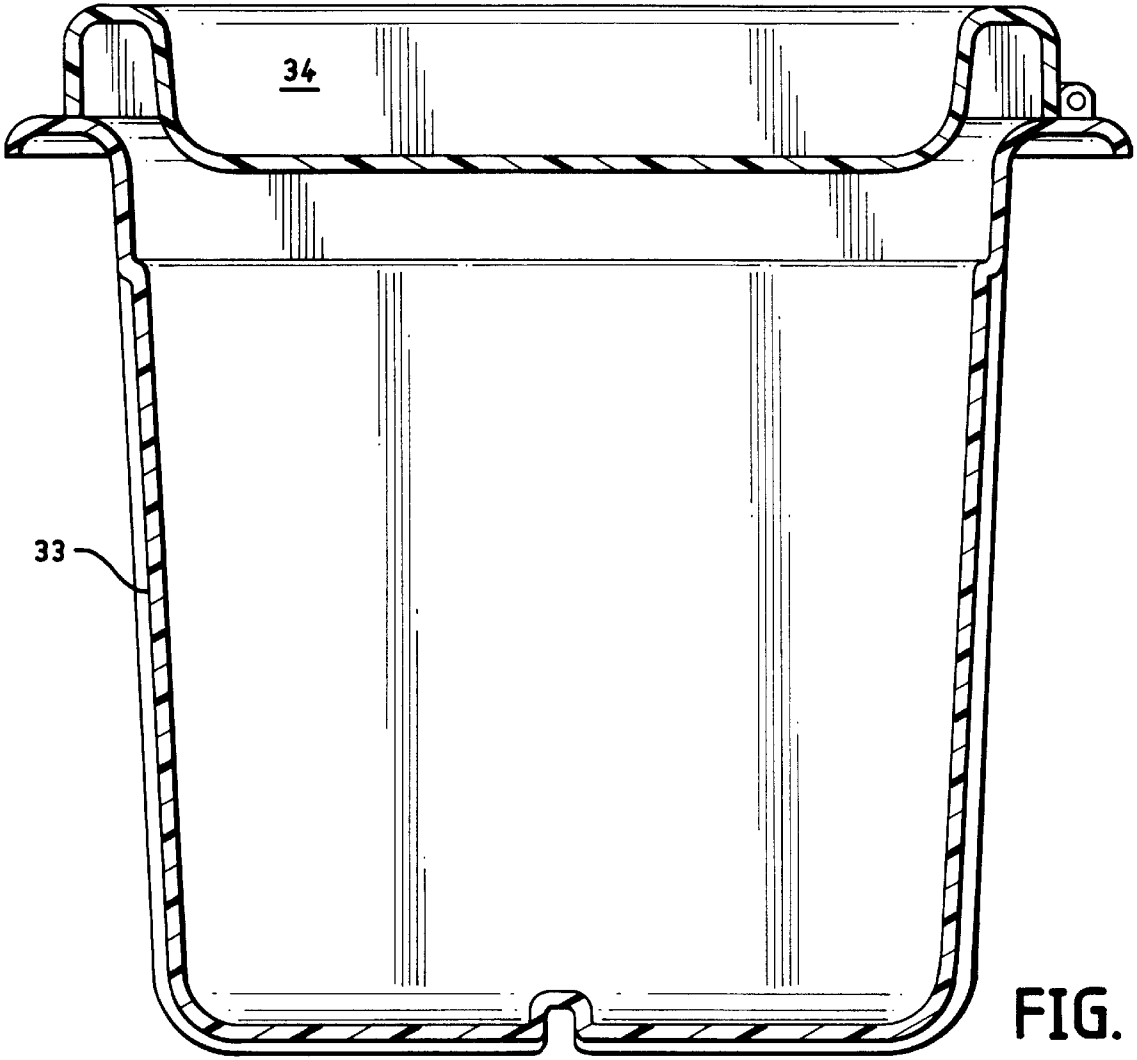
FIG. 2 is a cross-sectional view of one embodiment of the dispensing unit as contemplated by the present invention, demonstrating the stacking feature.
Figure 3:
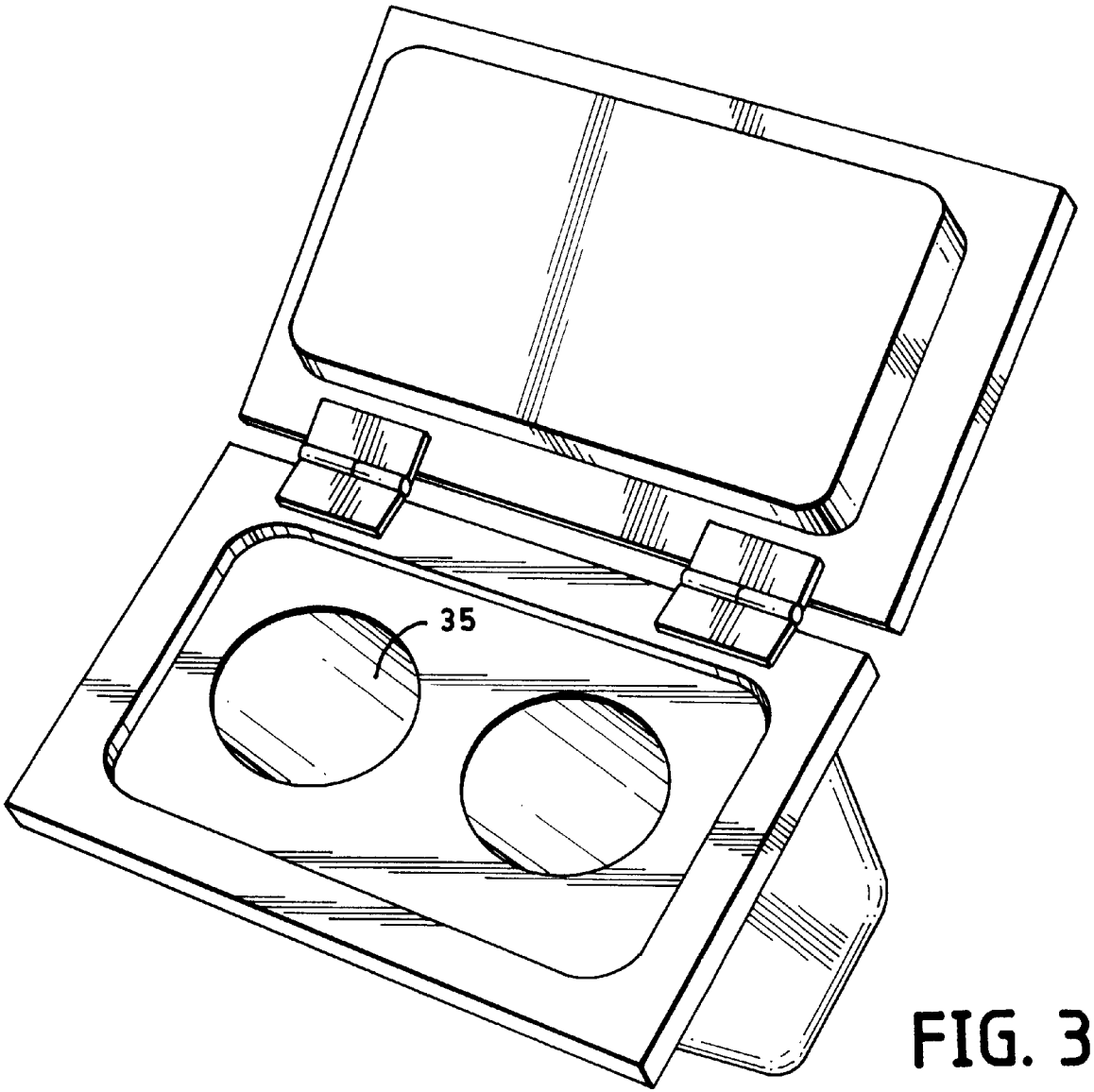
FIG. 3 is an overhead view of the transportable, stackable disposal bin container as contemplated by the present invention, configured to receive sharps and other medical waste.
Figure 4:
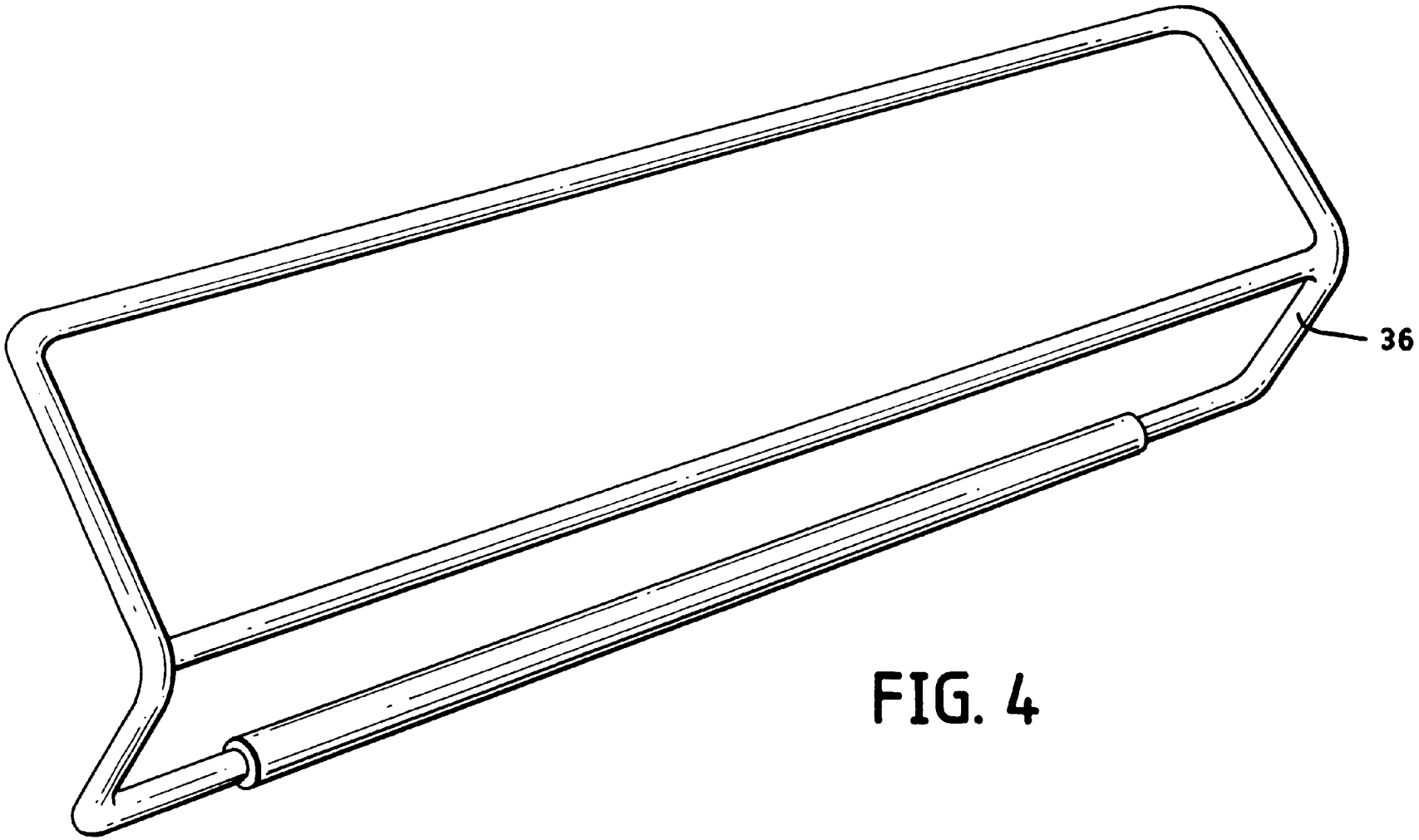
FIG. 4 is an overhead view of one embodiment of an adjustable bin bracket as contemplated by the present invention, to hold the containers in FIGS. 1–3.

The individual dispensing units (30) and the disposal bins (35), as shown in FIGS. 1 and 3, respectively, can be arrayed along the distal edge (12) of the primary work surface (10) in a variety of configurations, as demonstrated in FIGS. 6 through 9. It is contemplated that these dispensing units (30) and disposal bins (35) can be easily removed from the platform, and stacked for ease of transport when refilling or disposing of the contents. See FIG. 2. It is further contemplated that each slotted dispensing unit (30) can itself be configured according to a particular user's needs, by means of the insertion of a divider (31) into a series of vertical grooves (32) that run parallel to each other along the front and back walls of the dispensing unit base (33). See FIG. 1. The dispensing units (30) can therefore be configured as bins of various sizes to accommodate a variety of dental consumables and supplies.

One significant improvement of the present invention is obtained by the use of an adjustable, angled bin bracket (36) as a means for attaching the dispensing units (30) and disposal bins (35) to the primary work surface (10) of the dental delivery platform. This angled alignment allows a user to easily view the contents of each bin section in order to more efficiently select and retrieve the desired dental material. In the preferred embodiment the bin angle (37) is 55 degrees relative to the level primary work surface (10), although an appropriate range for the bin angle (37) is approximately 30–90 degrees. It is further contemplated that the hinged lid (34) of the dispensing unit (30) is composed of a non-opaque material, e.g., clear plastic, to allow for visual inspection without the need to open the lid (34) of the unit itself.

The second-tier structure (40) contemplated by the present invention may also take a number of alternative embodiments. In the preferred embodiment in FIG. 7, the second-tier structure consists of an angled platform (41) of Corian™ or a similar methacrylate resin material, mounted on supports (42) that are fastened directly to the primary work surface (10). In the preferred embodiment the second-tier platform angle (43) would be 30 degrees, although an acceptable range for the second-tier platform angle (43) would be 20–40 degrees relative to a level primary work surface (10).

This angled platform (41) would further incorporate a raised border (44) at its lower end, with an aperture (45) situated between said raised border (44) and the proximal or lower edge of the platform. It is further contemplated that the aperture (45) would be milled in accordance with the method of the present invention, and would run the width of said second-tier platform (41). This secondary work surface can therefore serve as a repository for dental instruments and the like, or as a staging area for bottles and sundries that are being used during a particular procedure. In addition, it is further contemplated that various types of dental hardware such as floss dispensers, computers, X-ray viewing machines and the like may also be incorporated onto this second-tier platform. This equipment can simply be placed on the existing platform structure, or alternatively can itself be mounted directly onto the support posts (42). See FIG. 9.

Figure 5:
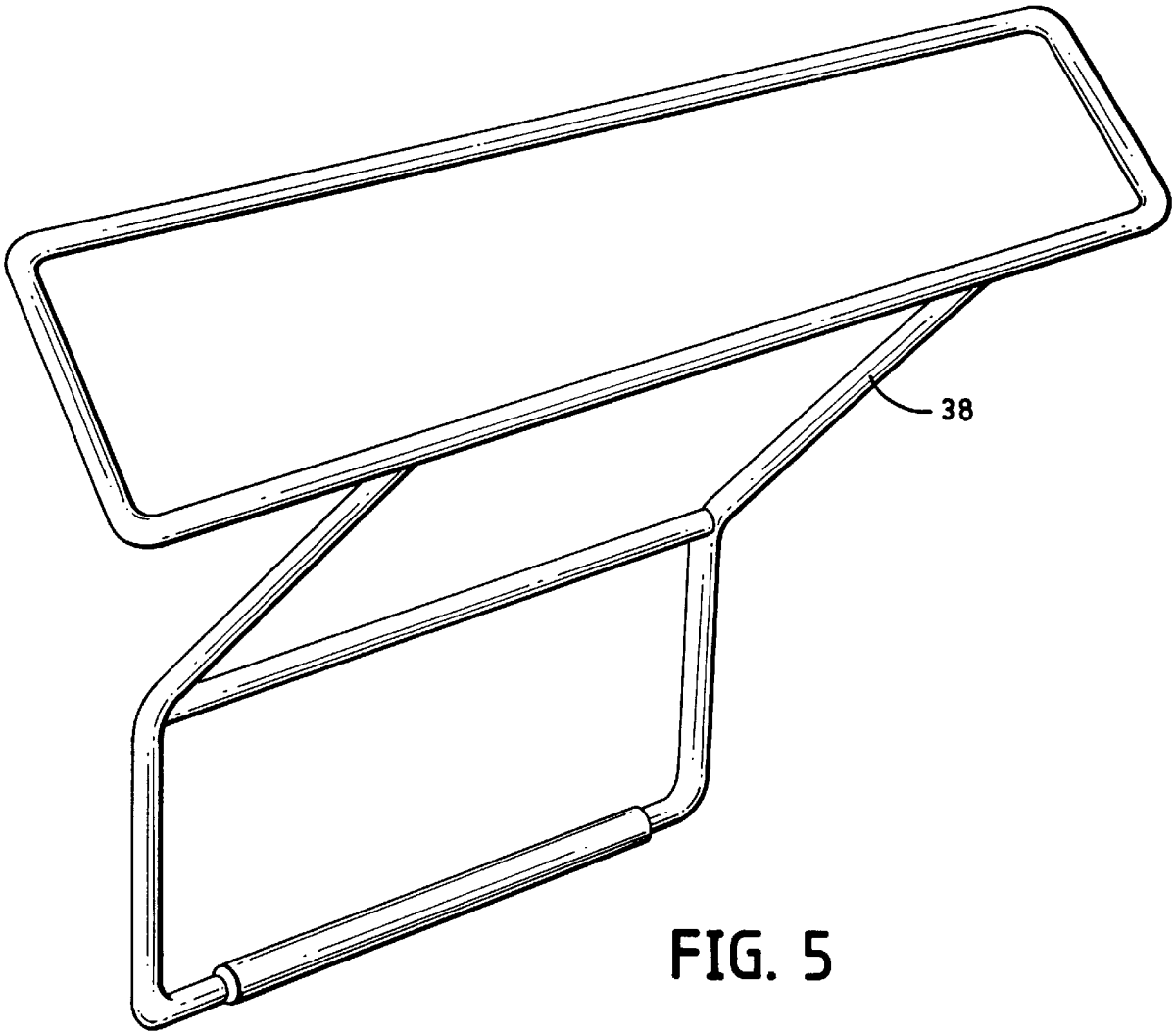
FIG. 5 is an overhead view of one embodiment of an adjustable, elongated bin bracket as contemplated by the present invention, to hold the containers in FIGS. 1–3.

In an alternative embodiment, the second-tier structure would consist of angled dispensing units (30) arrayed by means of an elongated bin bracket (38). See FIG. 5. In this particular configuration the secondary work surface of the dental delivery platform would then be suitable for access to and disposal of consumables and medical waste, respectively. In the preferred embodiment the bin angle (37) is 55 degrees relative to the level primary work surface (10), although an appropriate range for the bin angle (37) is approximately 30–90 degrees.

It is contemplated that the dental delivery platform of the present invention would be used as part of a comprehensive dental delivery system, in conjunction with a multi-functional foot control panel to activate and control the dental devices stored on the platform or in the instrument holders. In a preferred embodiment, the foot control panel would employ an infra-red transmitter for signaling in lieu of a conventional rheostat, thereby minimizing cable tangles and improving safety and efficiency in the dental workplace. It is further contemplated that a disposable power cassette can be used with the dental instruments and devices to further minimize cable tangle. It is also contemplated that an operator stool can be used in conjunction with the dental delivery system and the present invention, preferably one with an asymmetrical five-wheeled chair base that allows unrestricted access to the foot control panel beneath the dental platform. In addition, it is further contemplated that the comprehensive dental delivery system would include an overhead dental light, preferably one with a miniaturized design. The miniaturized design would serve to reduce contamination probability and allow positioning close to the patient, without interference with operator function.

Although a preferred embodiment has been described with some particularity, many modifications and variations of the preferred embodiment are possible without deviating from the invention. Furthermore, improvements and modifications which become apparent to persons of ordinary skill in the art only after reading this disclosure, the drawings and the appended claims are deemed within the spirit and scope of the present invention.

Accordingly, we claim:

1. A dental delivery platform having a partially uncovered one piece primary work surface with a plurality of inset instrument holders milled directly into a proximal and horizontal edge of said primary work surface, and a plurality of removable containers each having openings, said containers abutting a distal edge of said primary work surface such that a portion of said containers extends below a level of said primary work surface while said openings of said removable containers protrude above the primary work surface and a second-tier structure mounted so as to partially cover said primary work surface and leaving said primary work surface partially uncovered.

2. The dental delivery platform of claim 1, wherein said partially uncovered primary work surface is composed of a single sheet of methacrylate resin material.

3. The dental delivery platform of claim 1, wherein said partially uncovered primary work surface is composed of a single sheet of fiberglass material.

4. The dental delivery platform of claim 1, wherein said partially uncovered primary work surface is composed of a single sheet of hard plastic.

5. The dental delivery platform of claim 1, wherein said plurality of containers are attached to said partially uncovered primary work surface such that said openings of said containers are disposed at an angle between 30 and 60 degrees relative to said primary work surface.

6. The dental delivery platform of claim 1, wherein said plurality of containers comprise dispensing units, said dispensing units comprising surrounding walls and vertical partitions, said walls being interrupted at regular intervals by parallel grooves wherein said grooves provide a means to slidingly engage said vertical partitions so as to compartmentalize said dispensing units into bins.

7. The dental delivery platform of claim 1, wherein said plurality of containers includes disposal bins.

8. A dental delivery platform having a partially uncovered primary work surface composed of a single sheet of methacrylate resin material, with a plurality of inset instrument holders milled directly into a proximal and horizontal edge of said primary work surface, a plurality of removable containers each having openings, said containers abutting a distal edge of said primary work surface such that a portion of said containers extends below a level of said primary work surface while said openings of said removable containers protrude above the primary work surface, and a second-tier structure mounted on top of said primary work surface and partially covering said primary work surface and leaving said primary work surface partially uncovered, said second-tier structure comprised of a methacrylate platform angled between 20 and 40 degrees in regards to the plane created by said primary work surface.

9. The dental delivery platform of claim 8, wherein said plurality of containers are attached to said partially uncovered primary work surface such that said openings of said containers are disposed at an angle between 30 and 60 degrees relative to said primary work surface.

10. The dental delivery platform of claim 8, wherein said plurality of containers comprise dispensing units, said dispensing units comprising surrounding walls and vertical partitions, said walls being interrupted at regular intervals by parallel grooves wherein said grooves provide a means to slidingly engage said vertical partitions so as to compartmentalize said dispensing units into bins.

11. The dental delivery platform of claim 8, wherein said plurality of containers includes disposal bins.

12. A method, comprising:

a) providing i) a dental delivery platform having a partially uncovered one piece primary work surface with a plurality of inset instrument holders milled directly into a proximal and horizontal edge of said primary work surface, and a plurality of removable containers each having openings, said containers abutting a distal edge of said primary work surface such that a portion of said containers extends below a level of said primary work surface while said openings of said removable containers protrude above the primary work surface and a second-tier structure mounted so as to partially cover said primary work surface and leaving said primary work surface partially uncovered; and ii) one or more dental instruments; and b) placing said one or more dental instruments in said containers of said dental delivery platform.

* * * * *